United States Patent [19]

Calvino

[11] 4,223,191

[45] Sep. 16, 1980

[54] UPSTANDING MOUNTING STRUCTURE FOR HIGH-VOLTAGE THREE-BREAK LIVE-MODULE CIRCUIT-BREAKER

[75] Inventor: Ben J. Calvino, Monroeville, Pa.

[73] Assignee: Westinghouse Electric Corp., Pittsburgh, Pa.

[21] Appl. No.: 885,846

[22] Filed: Mar. 13, 1978

[51] Int. Cl.[2] ..... H01H 33/14; H01H 33/82

[52] U.S. Cl. ..... 200/145; 200/148 R; 200/148 A; 200/148 F

[58] Field of Search ..... 200/145, 148 R, 148 A, 200/148 D, 148 F; 361/331–334

[56] References Cited

U.S. PATENT DOCUMENTS

| | | | |
|---|---|---|---|
| 2,394,046 | 2/1946 | Dickinson | 200/145 |
| 2,824,196 | 2/1958 | Thommen | 200/148 F X |
| 2,979,591 | 4/1961 | Friedrich | 200/148 A |
| 3,167,630 | 1/1965 | Alderman et al. | 200/145 |
| 3,352,988 | 11/1967 | Wachta et al. | 200/145 X |
| 3,946,184 | 3/1976 | Yoshioka et al. | 200/148 F X |

*Primary Examiner*—James R. Scott
*Attorney, Agent, or Firm*—L. P. Johns

[57] ABSTRACT

An improved mounting support construction characterized by an arc-extinguishing puffer-unit at the upper end of each of the slanted arms, or generally-"V"-shaped supporting structure, with an additional third puffer-unit interposed, interconnecting, generally-horizontally-arranged, gas-sealed bridging center casing structure. Thus, a generally-inverted "A"-type of mounting support arrangement is provided in which the three series puffer-units are disposed at the lower ends and in the horizontal bridging leg of the inverted "A"-shaped structure. A typical voltage rating would be 420 K.V., for example.

4 Claims, 12 Drawing Figures

ELEMENT "A"

ELEMENT "B"

UPSTANDING MOUNTING STRUCTURE FOR HIGH-VOLTAGE THREE-BREAK LIVE-MODULE CIRCUIT-BREAKER

CROSS-REFERENCE TO RELATED APPLICATIONS

Reference may be made to a companion U.S. patent application, filed April 1, 1978, Ser. No. 882,593, by the same inventor as in the instant application, illustrating a novel type of structural upstanding supporting arrangement, which may be utilized in a three-break, or, alternatively, in a four-break type of circuit-interrupting assemblage, and, as in the instant application, particularly adapted for the use of puffer-type interrupting units in certain applications.

BRIEF SUMMARY OF THE INVENTION

In accordance with the present invention, there is provided a novel, upstanding, structural supporting mounting arrangement for a high-voltage, three-break, circuit-interrupting assemblage, particularly adapted for the use of the usual puffer-type interrupting units, for example, disposed in electrical series arrangement for interrupting the higher-voltage ratings such as 420 K.V. A unique characteristic of the present mounting invention is the use of only a single, upstanding, lower-disposed, hollow, supporting "first" column structure. An insulating vertical "first" operating rod extends upwardly, interiorly of said single, lower-disposed, upstanding, hollow first supporting column structure, which is mechanically linked by a mechanism, disposed within a mechanism housing, the latter surmounting said single, "first", upstanding, lower-disposed column structure, to a pair of adjoining, slanted, angularly-disposed, additional, "second" supporting hollow column structures, each of which preferably supports therewithin a puffer-type interrupting unit adjacent its outer free end; and an additional, puffer-type, third bridging interrupting puffer unit is disposed within a generally-horizontally-disposed, bridging, gas-sealed casing structure, which is electrically connected adjacent the mid-points, generally, of the outer-disposed generally-slanted, hollow, column supporting arrangement. Thus, there results a three-break interrupting device in which each series break is associated with a puffer-type, compressed-gas circuit-interrupter, for example.

In substitution of the aforesaid puffer-type, compressed-gas arc-extinguishing unit, there may be substituted, alternatively, when desired a vacuum "bottle". Merely for purposes of convenience and for certain particular applications, is the use of a puffer-type, compressed-gas unit preferred.

BRIEF DESCRIPTION OF THE DRAWINGS

FIG. 9 illustrating such a puffer-type, arc-extinguishing unit during an intermediate portion of the opening operation, with the contacts separated and the direction of gas flow being indicated;

DESCRIPTION OF THE PREFERRED EMBODIMENT

Figure 2:
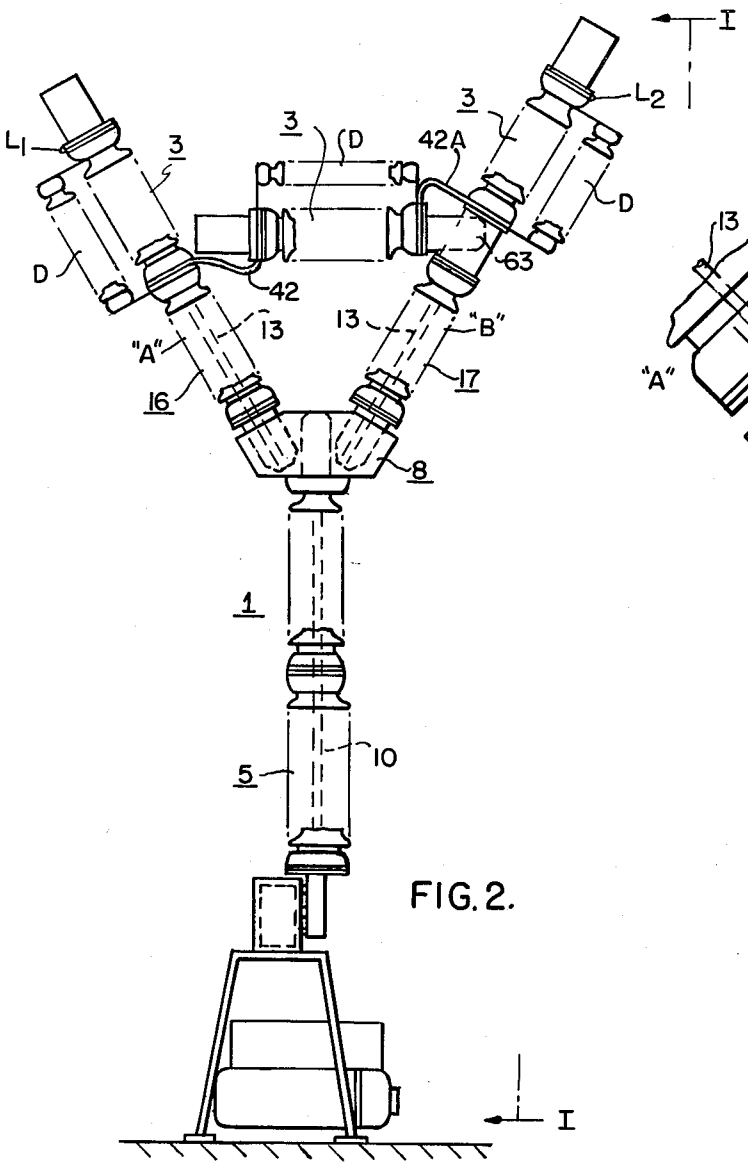
FIG. 2 is a side-elevational view of the single-phase, high-voltage, three-break circuit-interrupter assemblage of FIG. 1, the view being taken, generally, along the line II—II of FIG. 1.
Figure 1:
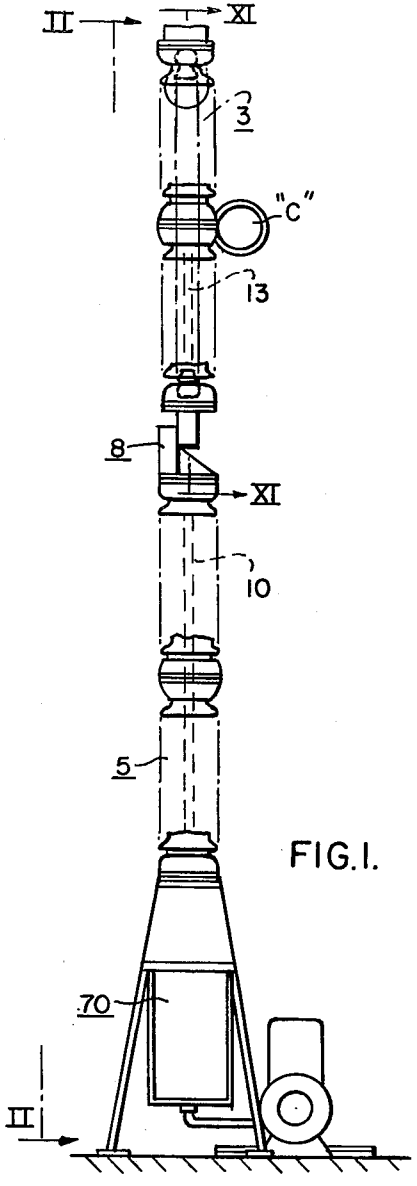
FIG. 1 is a front elevational view of a three-break, single-phase, circuit-interrupting assemblage, embodying the principles of the present invention, the view being taken, generally, along the line I—I of FIG. 2, looking in the direction of the arrows.
Figure 5:
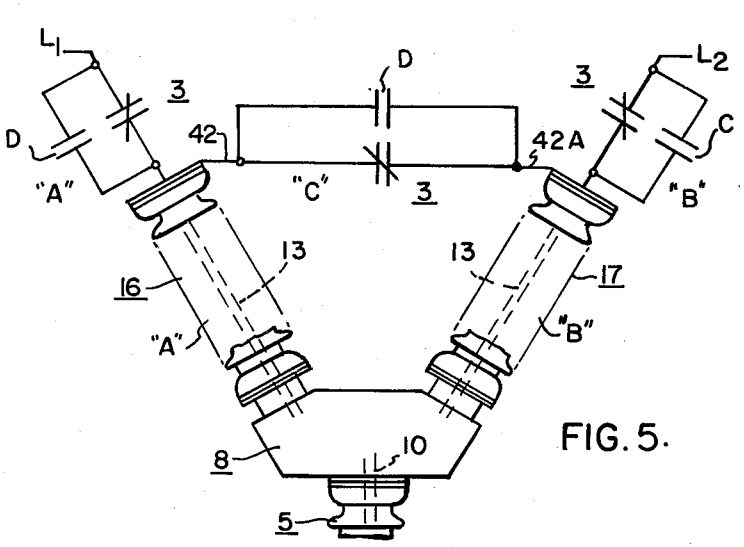
FIG. 5 is a diagrammatic circuit arrangement of the three-break interrupting device of FIGS. 1 and 2, with the separable contacts being illustrated in the closed-circuit position.
Figure 4:
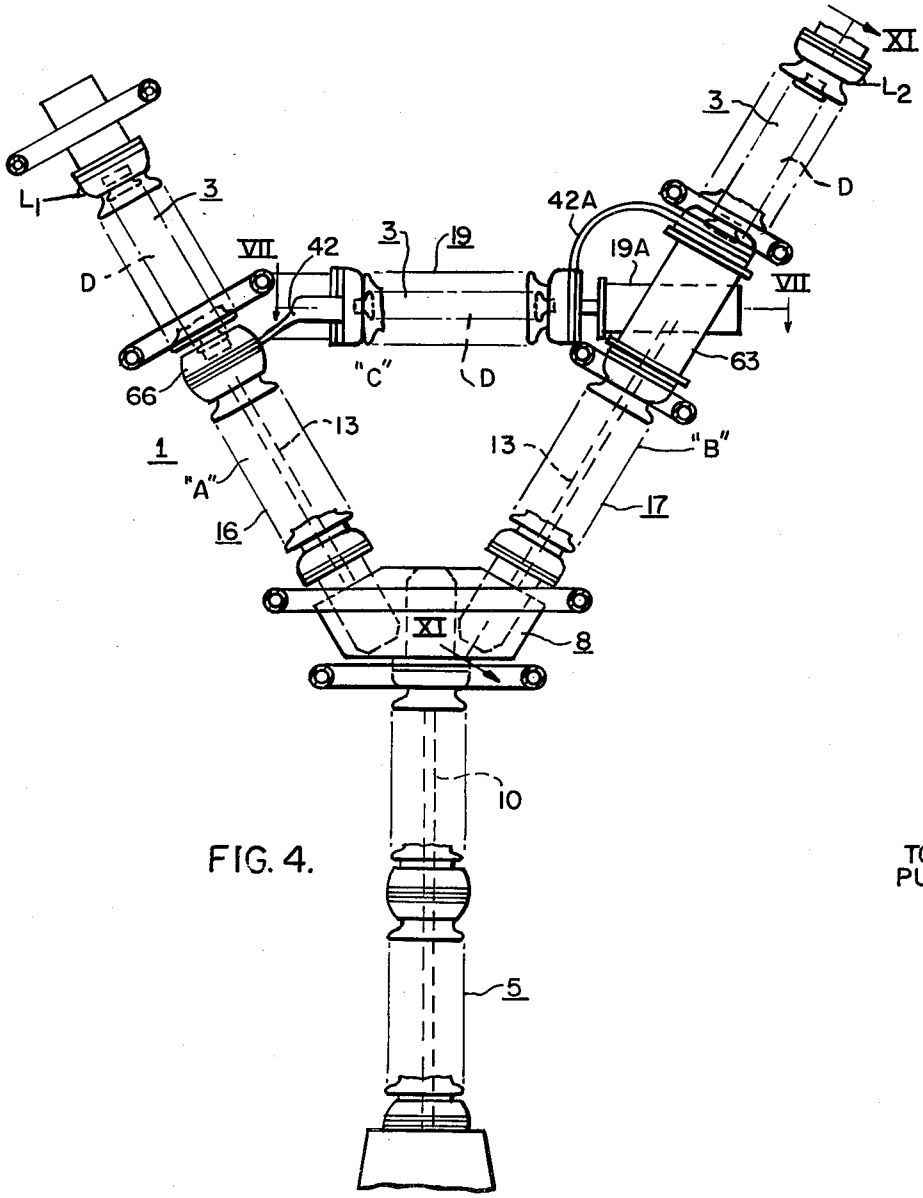
FIG. 4 is a considerably-enlarged, side-elevational view of the pole-unit of the single-phase, multiple-break circuit-interrupting assemblage of FIGS. 1 and 2, the structure being illustrated in the closed-circuit position.
Figure 8:
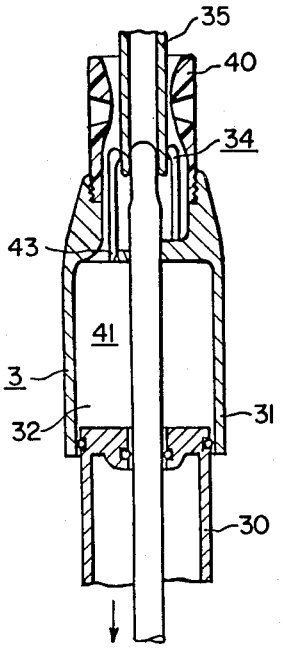
FIGS. 8 and 9 illustrate, in detail, sectional views of one of the plurality of puffer-type interrupting units, with FIG. 8 illustrating such a puffer-unit in the closed-circuit position.
Figure 9:
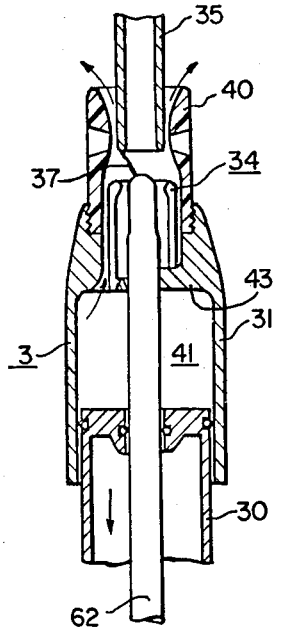

Referring to the drawings, and more particularly to FIGS. 1, 2 and 4 thereof, it will be observed that there is illustrated a single-phase, high-voltage, circuit-interrupter assemblage 1, in this instance being of the compressed-gas, three-break, puffer-type, having three electrical breaks in series, as illustrated diagrammatically in FIG. 5, and each of the puffer-units 3 being of the type as illustrated in FIGS. 8 and 9 of the drawings.

With further reference being directed to FIG. 4 of the drawings, it will be observed that there is generally provided a single, sole, "first" hollow, upstanding, insulating column structure 5. Surmounted at the upper end of the first hollow, single, upstanding insulating column structure 5 is a metallic mechanism housing 8, illustrated more clearly in FIG. 3 of the drawings, and adapting the motion of the lower-disposed, vertically-extending, first operating rod 10, within the first column structure 5, to actuate additional, "second", angularly-extending, insulating operating rods 13, which extend interiorly through additional, hollow "second", insulating column structures 16 and 17 (FIGS. 10 and 11).

Disposed at the outer free ends of the second, angularly-extending, hollow column structures 16 and 17 is a pair of series puffer-type interrupting units 3 of the general type, as illustrated in FIGS. 8 and 9.

Figure 3:
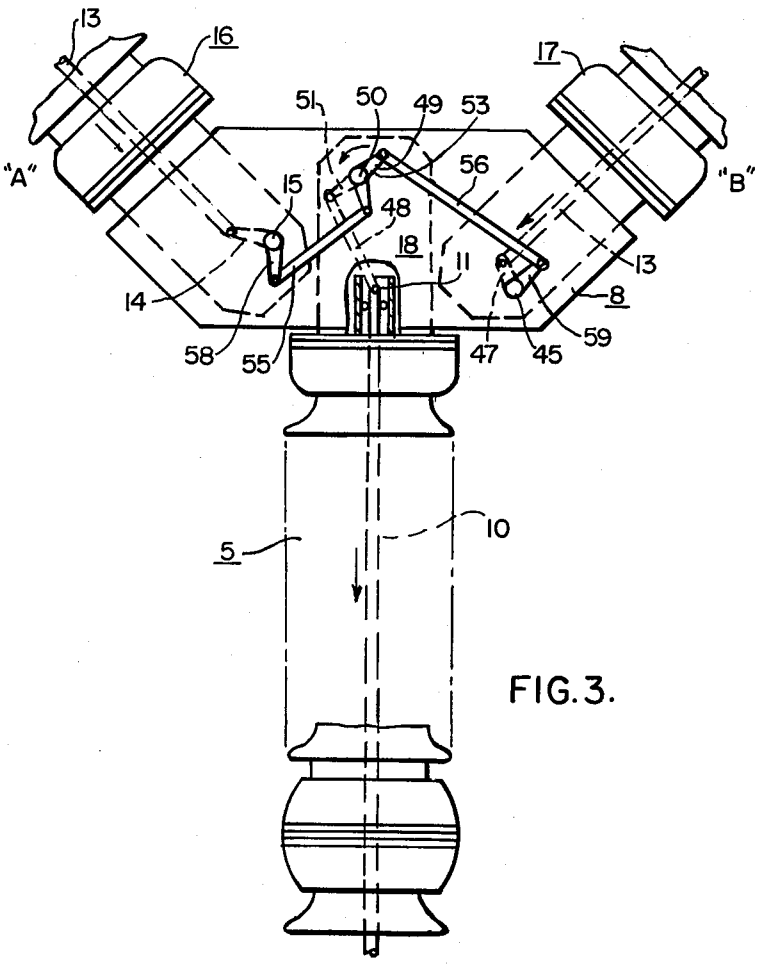
FIG. 3 illustrates a sectional view of the metallic mechanism housing, and linkage arrangement disposed therein, of the "first" mechanism housing, which surmounts the lower-disposed single "first", upstanding, hollow insulating column structure of FIG. 2, and indicating its adaptability for operating a plurality of puffer-type series units by the use of "second" insulating operating rods, which latter extend through angularly-arranged, "second", hollow, insulating slanted column structures, the latter surmounting, or extending upwardly from such a "first" mechanism housing, and the linkage parts therewithin being illustrated in the closed-circuit position.
Figure 10:
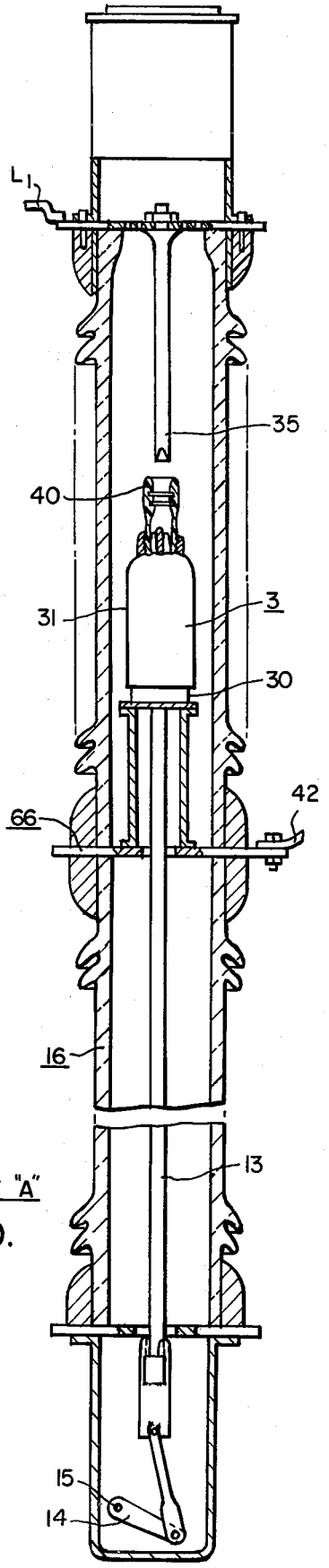
FIG. 10 illustrates a sectional view taken through the angular interrupting element "A" of FIG. 2.
Figure 11:
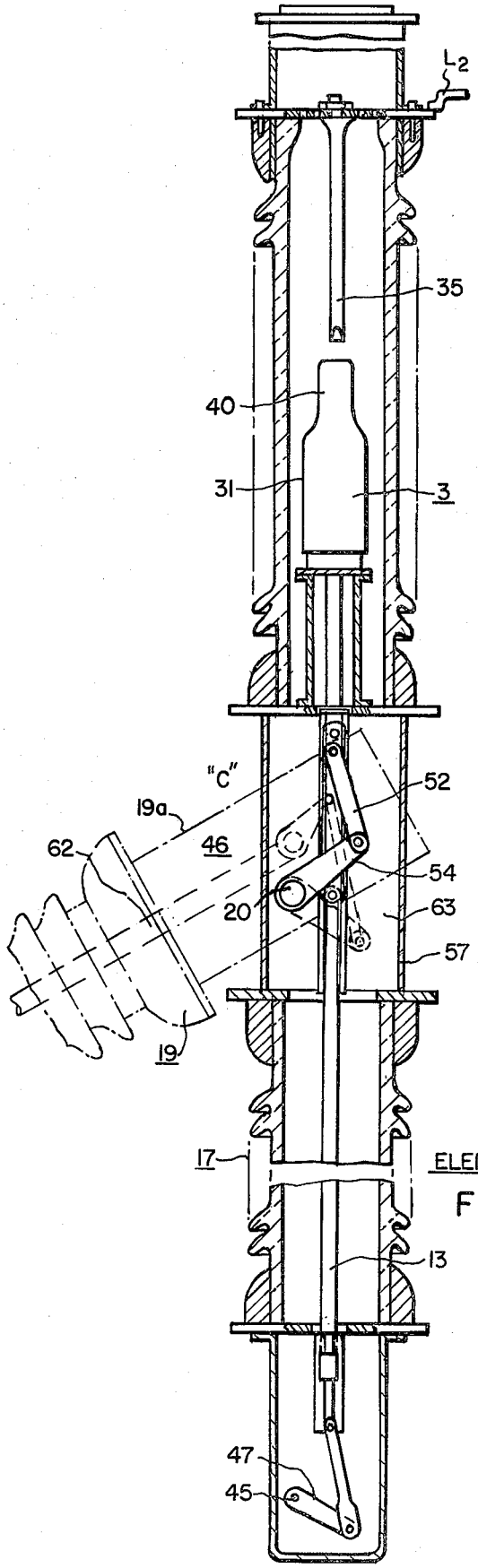
FIG. 11 illustrates a sectional view of the interrupting element "B" of FIG. 2 taken through the right-hand "second" column structure of FIG. 4, again the contact structure being illustrated in the closed-circuit position, the view being taken along the line XI—XI of FIG. 4.

FIG. 10, which is a sectional view taken along the left-hand arm, or branched structure 16 of the "V"-shaped assemblage 1, illustrates the general arrangement of a reciprocally-operable, insulating operating rod 13, which is actuated by a crank-arm structure 14 disposed interiorly at the lower end of the hollow gas-filled column structure 16, which crank-arm structure 14 (FIG. 10) is actuated by a generally-horizontally-extending shaft 15, which is rotated by a linkage 18, as more clearly illustrated in FIG. 3 of the drawings.

Generally, the series electrical circuit $L_1$-$L_2$ passes through the three-break interrupting device 1 in the manner as illustrated in FIG. 5 of the drawings.

Figure 7:
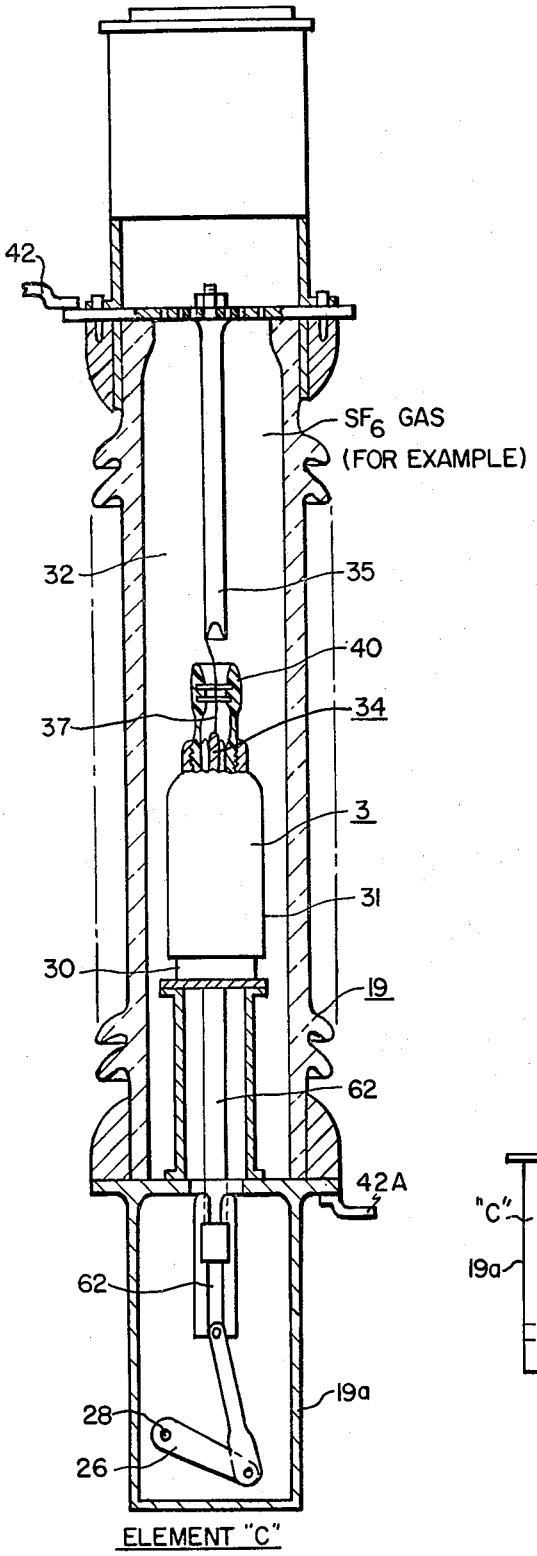
FIG. 7 is a longitudinal, sectional view of the horizontal interrupting element "C" of FIG. 2, taken generally along the line VII—VII of FIG. 4.

FIG. 7 illustrates a longitudinal sectional view taken generally along the line VII—VII of FIG. 4 to illustrate the interior puffer-units 3 of the middle, sealed, horizontal bridging casing structure 19, or element "C", having the puffer-type interrupting unit 3 adjacent its left-hand end. As is well known by those skilled in the art, the central casing structure 19 is gas-sealed and includes a stationary horizontal piston structure 30, over which horizontally slides a movable operating cylinder 31 compressing gas, such as $SF_6$ gas 32 for example, within a chamber 41 (FIG. 9) therebetween. The movable hollow operating cylinder 31, additionally carries the horizontally-movable contact structure 34, which separates from the stationary contact structure 35, drawing an arc 37 axially through a movable insulating nozzle 40, also carried by the movable operating cylinder 31, in a manner more clearly illustrated in FIG. 9 of the drawings.

Gas flow, compressed within the compression chamber 41 (FIGS. 8 and 9), passes through a supporting spider arrangement 43 and also through the interior of the hollow insulating movable orifice 40 to effect thereby extinction of the arc 37 established horizontally through the movable orifice 40.

With the three-break interrupter assemblage 1, as illustrated in FIGS. 1 and 2, and as electrically diagrammatically illustrated in FIG. 5, it will be apparent that there are two such puffer-type interrupting units 3 (as shown in FIGS. 8 and 9) associated with the slanted, angularly-extending column structures 16, 17, as designated by the letters "A" and "B" of FIG. 4.

As shown in FIG. 3, a floating link 48 pivotally connected at 11 to the upper end of the lower operation rod 10 rotates the driving crank arm 51 and hence the drive shaft 50. Further, with reference to FIG. 3, which shows the lower-disposed linkage 18, it will be observed that there is provided a bell-crank lever 49 mounted upon a horizontally-extending drive shaft 50, and having a pair of rotatable arms 51, 53 fixedly secured thereto. At the outer end of each of the arms 51 and 53 are floating links 55 and 56, which connect to additional crank-arms 58 and 59 associated with the lower ends of each of the second, angularly-extending, hollow insulating column structures 16 and 17. The right-hand "second" insulating operating rod 13 links, additionally, with a further common mechanism housing 63, which is illustrated in FIG. 6, thereby giving rise to operating movement of a horizontal "third" insulating operating rod 62, which effects actuation of the horizontal, middle operating cylinder 31 (FIGS. 8 and 9), which is enclosed within the middle bridging horizontally-extending insulating hollow casing structure 19.

Figure 6:
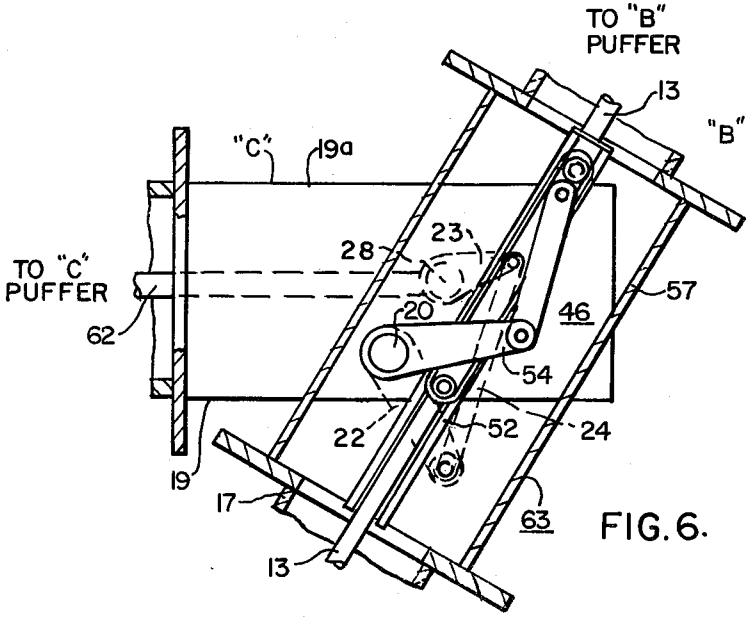
FIG. 6 illustrates, to an enlarged scale, a sectional view of a "second" common upper-disposed mechanism housing, which is disposed adjacent the generally-mid-portion of the right-hand, angularly-extending hollow "second" column structure, with the internal linkage parts therein adaptable for simultaneously effecting opening and closing motions of the horizontally-extending, intervening, middle puffer unit, which is interposed horizontally in bridging relationship between the outermost puffer-units, again the several parts being illustrated in the closed-circuit position.

FIG. 6 illustrates in detail, the "second" mechanism housing 63, which accommodates the longitudinal movement of the angularly-extending, right-hand reciprocally-operable, insulating operating rod 13 (FIG. 11) associated with the right-hand puffer-type interrupting element "B", to effect additionally, the rotation of an internal crank-arm 54 (FIG. 6), which is disposed interiorly of the cylindrical metallic portion 57 of the mechanism-housing 63. This rotation of the crank arm 54 rotates the drive shaft 20 which is thereby rotated in response to longitudinal opening and closing movements of the right-hand insulating operating rod 13 and consequently effects rotation through the drive shaft 20 and external crank-arms 22, 23 and floating link 24 of an interiorly-disposed crank-arm (FIG. 7) disposed within the right-hand end 19*a* of the generally-horizontally-extending sealed casing structure 19. A drive shaft 28, internal to the gas-sealed casing structure 19, is rotated by the externally-disposed crank-arm 23.

As will be obvious, this interiorly disposed crank-arm 26 effects opening and closing movements of the insulating "third" operating rod 62, which extends generally horizontally within the intervening, or interposed gas-sealed casing structure 19 to thereby operate the middle puffer-type, interrupting unit "C".

At the left-hand end of the intervening, or interposed puffer-type interrupting unit "C" there is, as shown more clearly in FIG. 4, a flexible connector 42, which connects the stationary contact structure 35 of the middle puffer-type "C" to the conducting support 66 (FIG. 10) for the stationary piston structure 30 of the left-hand puffer-unit 3 in column structure 16.

From the foregoing, it will be apparent that vertical opening and closing movements of the lower-disposed single, "first" insulating operating rod 10, which extends to ground potential, and is operated by any convenient mechanism 70 (FIG. 1) at ground potential, will, through the intervention of the central crank-arm 49 (FIG. 3), effect, in turn, rotation of the two crank-arms 51, 53 each of which effects operation of the two puffer-type interrupting elements "A", "B" at the outer free ends of the slanted arms, or column structure 16, 17 of the V-shaped interrupting structure 1 as shown in FIG. 5, D indicates a condenser associated with each interrupting units 3.

Figure 6A:
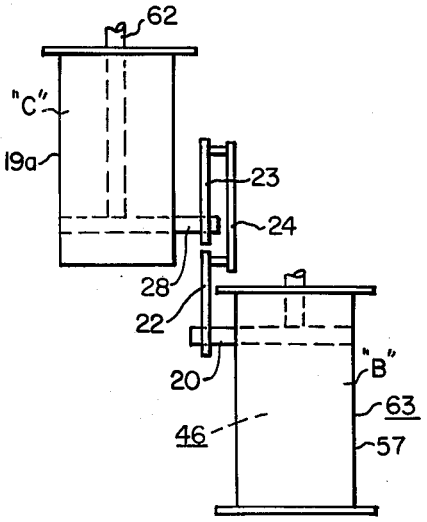
FIG. 6A is an illustration of the linkage between the column structures of FIG. 6.

The presence of the "second" mechanism housing 63 (FIG. 6) accommodates such opening and closing movements of the right-hand, angularly-extending, insulating operating rod 13 to effect, concommitantly, opening and closing movements of the insulating operating rod 62 for effecting motion of the movable operating cylinder 31 of the middle puffer-type interrupting elements "C". FIG. 6A illustrates this linkage more clearly.

From the foregoing description, it will be apparent that there is provided an improved single-phase, high-voltage, compressed-gas circuit-interrupting assemblage 1, as illustrated with respect to FIGS. 1 and 2, each pole-unit comprising a single, upstanding hollow, "first" insulating column structure 5, which at its upper end supports the "first" common mechanism housing 8. Angularly-extending or slanting "second" hollow column structures 16, 17 surmount such aforesaid common metallic mechanism housing 8, and through each of which extends "second" insulating operating rods 13 for giving rise to the contact actuation of the end puffer-type interrupting elements "A" and "B".

The intervening bridging, middle, puffer-type interrupting elements "C" is, as mentioned, actuated by the crank-arm linkage 46 disposed within the interconnecting, metallic, crank-arm mechanism housing 63 (FIG. 6), which operates the horizontal drive shaft 28 extending externally thereto to operate the crank-arm 26 (FIG. 7) of the intervening bridging middle puffer-type interrupting elements "C".

The electrical circuit (FIG. 5) extends from the power conductor $L_1$ sequentially through the interrupting element "A", the conductor 42, the interrupting element "C", the conductor 42A, the interrupting element "B", and to the power conductor $L_2$. All three of the puffer-type interrupting elements "A", "B" and "C" are electrically connected in electrical series, and thus results in the simultaneous operation of a three-break interrupting assemblage 1. Also, all may be of modular construction, as shown in FIGS. 7, 10 and 11.

It will be observed that the shafts 15, 50 and 45 of the mechanism 18 of FIG. 3 extend on the outside of the gas-sealed column structures 16 and 17, and effect operation of a pair of interiorly-disposed, rotatable crank-arm structures 14 and 47, which themselves, in turn, effect operation of the interiorly-disposed, "second" slanted insulating operating rods 13.

FIG. 11 is a sectional view taken through the modular right-hand "second" column structure 17 and showing the mechanical interconnection of the slanted operating rod 13 movable in a raceway 52 and operating the crank arm 54 of the horizontal drive shaft 20. This view of FIG. 11 shows the device, interrupting element "B", in the open-circuit position.

Although puffer-type, gas-blast, interrupting units 3 have been illustrated, as shown in FIGS. 8 and 9, it is to be clearly understood that the instant application is importantly particularly directed to a structural mounting supporting arrangement, and not to any particular type of arc-extinguishing units 3. In other words, vacuum-type interrupting units (not shown) may be used in place of the gas-blast, puffer-type, interrupting unit 3, as illustrated in FIGS. 8 and 9. Depending merely upon the requirements, the environment and other consideration, arc-extinguishing units 3 of different types may lend themselves to use. As mentioned, the instant application is directed particularly to the structural mounting arrangement, and the operating rods 13, 62 for effecting actuation of the three modular puffer-type interrupting elements "A", "B" and "C", which, however, themselves individually may be of a wide variety of types. The device, as shown, is suitable for interrupting voltages of the order of 420 K.V., for example.

Although there has been illustrated and described a specific structure, it is to be clearly understood that the same was merely for the purpose of illustration, and that changes and modifications may readily be made therein by those skilled in the art, without departing from the spirit and scope of the invention.

I claim:

1. A high-voltage three-break circuit-interrupting assemblage comprising a single, solitary, upstanding hollow insulating first column (5), a mechanism housing (8) surmounting said first upstanding hollow column and structurally connected to a pair of angularly-extending, second hollow column structures (16, 17), a generally-horizontally-extending hollow column structure (19) extending horizontally and meeting said second column structures (16, 17) adjacent the mid-points thereof, an arc-extinguishing unit (3) disposed interiorly of each of the second and horizontally-extending hollow column structures and being electrically interconnected in series, and a second mechanism housing (63) disposed adjacent one end of the horizontally extending hollow column structure, mechanical means for opening and closing electric circuits through the serially connected arc-extinguishing units and including motion-conveying operating rods and linkage operatively connected to each unit, said linkage extending through the interconnected first column, mechanism housing, second hollow column structures, second mechanism housing, and horizontal-extending hollow column, whereby simultaneous operation of the three arc-extinguishing units (3) occurs in response to operation of mechanical means.

2. The combination according to claim 1, wherein each of the arc-extinguishing units comprises a puffer-type arc-extinguishing unit having a relatively-fixed piston structure and an operating cylinder which slides over the relatively-fixed piston structure and carries therewith a movable nozzle and a movable contact structure of the particular unit.

3. In combination, a high-voltage, multi-break, circuit-interrupting assemblage comprising a single solitary upstanding hollow insulating first column structure, a first mechanism housing surmounting said first column structure and structurally connected to a pair of angularly-extending second hollow column structures, means defining a generally-horizontally-extending sealed casing structure interconnecting the angularly-extending second hollow column structures, the arrangement generally resembling an inverted "A" supported by the single solitary upstanding hollow insulating column structure, an arc-extinguishing unit disposed interiorly within each of the second column structures, a third arc-extinguishing structure disposed interiorly within the generally-horizontally-extending connected casing structure, mechanical means for opening and closing electric circuits through the serially connected arc-extinguishing units and including motion-conveying operating rods and linkage extending through the interconnected first and second column structures and the horizontally-extending sealed casing structure, whereby a three-break extinguishing-structure results.

4. The combination according to claim 3, wherein the arc-extinguishing units are puffer-type compressed-gas extinguishing units, each comprising a relatively-movable piston and cylinder arrangement.

* * * * *